US005904282A

United States Patent [19]

Gleason

[11] Patent Number: 5,904,282

[45] Date of Patent: May 18, 1999

[54] EXTERNAL FRAME BACKPACK HARNESS

[75] Inventor: Dana W. Gleason, Bozeman, Mont.

[73] Assignee: K-2 Corporation, Vashon, Wash.

[21] Appl. No.: 08/891,501

[22] Filed: Jul. 11, 1997

Related U.S. Application Data

[63] Continuation-in-part of application No. 08/689,821, Aug. 14, 1996, Pat. No. 5,762,251.

[51] Int. Cl.[6] ..... A45F 3/08

[52] U.S. Cl. ..... 224/635; 224/263; 224/636

[58] Field of Search ..... 224/635, 636, 224/637, 641, 263, 262

[56] References Cited

U.S. PATENT DOCUMENTS

| | | | |
|---|---|---|---|
| 204,066 | 5/1878 | Merriam | 224/636 X |
| 3,516,586 | 6/1970 | Farnbach . | |
| 3,536,237 | 10/1970 | Greenman . | |
| 3,563,431 | 2/1971 | Pletz | 224/263 X |
| 3,889,859 | 6/1975 | Joseph | 224/635 X |
| 3,899,109 | 8/1975 | Noice | 224/263 X |
| 3,923,216 | 12/1975 | Farnbach . | |
| 4,015,759 | 4/1977 | Dreissgacker et al. . | |
| 4,074,839 | 2/1978 | Wood et al. | 224/635 |
| 4,194,656 | 3/1980 | Zufich . | |
| 4,369,903 | 1/1983 | Wilkes . | |
| 4,480,775 | 11/1984 | Stanford | 224/635 |
| 4,676,418 | 6/1987 | Lowe . | |
| 4,982,884 | 1/1991 | Wise . | |
| 5,005,744 | 4/1991 | Gleason . | |
| 5,090,604 | 2/1992 | Howe | 224/641 |
| 5,503,314 | 4/1996 | Fiscus . | |

FOREIGN PATENT DOCUMENTS

| | | |
|---|---|---|
| 1 124 693 | 7/1979 | Canada . |
| 0 350 841 | 1/1990 | European Pat. Off. . |
| 910 436 | 11/1944 | France . |
| 38 44675 | 12/1988 | Germany . |
| 379625 | 9/1932 | United Kingdom . |
| WO 91/05494 | 5/1991 | WIPO . |
| WO 93/14669 | 8/1993 | WIPO . |

*Primary Examiner*—Renee S. Luebke
*Attorney, Agent, or Firm*—Darren J. Jones

[57] ABSTRACT

An external frame backpack (10) includes a frame (14), a hip belt (32), two flexible stays (50, 52), a back panel (38), and a lower panel (40). The frame is external and substantially rigid. It includes upper, middle, and lower frame members (22, 24, 26) secured between frame siderails (18, 20). The hip belt is attached to the frame adjacent the lower frame member. The flexible stays are elongate with upper and lower ends. The upper ends attach to the upper frame member. The lower ends attach to the sides of the hip belt. The stays are flexible to allow movement of the hip belt as the stays bend while transmitting at least a portion of the weight held on the frame to the lower end of the stays. The back panel is vertically and horizontally tensioned and secured to the frame. The lower panel is secured between the siderails of the frame. The lower panel includes a support sheet (66) to maintain the shape thereof when tensioned between the siderails. In another aspect disclosed herein the back panel secures to the frame vertically with upper and lower sleeves that taper to fit onto tapered upper and lower ends of the backpack siderails. Vertical adjustability of the back panel is provided by adjustment fasteners securing the back panel to the sleeves.

23 Claims, 9 Drawing Sheets

EXTERNAL FRAME BACKPACK HARNESS

RELATED APPLICATIONS

This is a continuation-in-part of utility application Ser. No. 08/689,821 filed Aug. 14, 1996 and now U.S. Pat. No. 5,762,251.

FIELD OF THE INVENTION

The present invention relates to backpack frames and harnesses for carrying loads, and more particularly, to harness systems for external frame backpacks.

BACKGROUND OF THE INVENTION

External frame backpacks are particularly well suited for carrying heavy, bulky loads by backpackers. The load is carried a small distance away from the back of the user and is secured to a rigid frame that can transmit the load primarily to the hip belt. However, with conventional frames and hip belts, the load is not effectively transferred to the sides of the hips, the location most comfortable over a long haul. Instead the load is mainly carried on the small of the back as the hip belt sags and pulls from behind.

Some attempts at overcoming this loading have been made by the use of straps and other equipment. For example, one attempted solution employs T-shaped arms rigidly secured to the frame rails and extending forwardly to an attachment with the sides of the hip belt. This arrangement will transfer the load to the sides of the user's hips, but may also cause the pack to shift or swing side to side with every natural hip movement of the user. The connection is kept somewhat rigid for effective transfer of the load to the user's hips.

Other problems with external frame pack harnesses involve the back and lower panels that are used to suspend the pack frame away from direct contact with the user's back. These panels are strapped to the siderails of the pack and held in tension horizontally. They may, therefore, develop horizontal wrinkles or folds that feel uncomfortable on the back of the user. Furthermore, the load may not be effectively and evenly distributed across these panels for a comfortable carry.

Owing to the limitations of the current external frame packs, the advantages of these packs as effective big-load haulers is overshadowed. Therefore, a need exists for a rigid external frame pack with a flexible harness system that effectively carries a load comfortably on the user's back with the bulk of the downward force transferred to the sides of the hips of the user without pack instabilities being created when hiking.

SUMMARY OF THE INVENTION

The present invention provides a backpack including a frame, a back panel, a tensioning member, and a lower attachment member. The frame includes side members, a first upper member, and at least two lower members. The lower members extend at least somewhat upwardly and at least portions thereof incline with respect to each other. The back panel is secured between the side members and has upper and lower ends between the upper and lower frame members. The tensioning member vertically tensions the back panel. The tensioning members secure to the upper and lower end of the back panel. The lower attachment members secure to the lower end of the back panel and between the lower frame members. The tension member vertically secures the lower end of the back panel to the frame. Vertical tensioning of the back panel tautly secures the lower attachment member to the lower frame members.

In one preferred aspect of the invention, the lower members slant away from each other as they extend upwardly. The lower attachment member includes a sleeve extending around the lower frame members. Thus, vertical tensioning of the back panel tightens the sleeve onto the lower members as the sleeve is forced toward portions of the lower members disposed farther apart. Preferably, these lower frame members are integrally formed with the side members of the frame. The side members taper toward each other at least at their lower portions as they extend downwardly forming the lower members. This lower sleeve further forms a support structure for attachment of the hip belt thereto. The lumbar pad may also attach to the sleeve or to the hip belt.

In one preferred aspect of the invention, the lower attachment member includes a crossbar attached to the sleeve near an upper margin thereof. The lower end of the back panel is attached to the crossbar. The crossbar preferably is constructed of fiberglass.

In one preferred aspect, the upper end of the back panel includes at least one strap engaging the upper member. The strap extends from the upper member down to the sleeve and attaches to the sleeve. The strap includes a length adjuster. The lower end of the back panel adjustably connects to the sleeve. Combination of the length adjuster and the adjustable connection of the lower end to the sleeve allows the vertical position of the back panel to be shifted by changing these adjustment connections. Note that the shoulder pads are also attached to the back panel such that any shifting of the back panel will adjust the shoulder pads.

In another aspect of the invention the frame further includes a second upper member. The upper members extend at least somewhat downwardly and have at least portions thereof inclined with respect to each other. The backpack also includes an upper attachment member secured to the upper end of the back panel and attached between the first and second upper frame members. The upper attachment member vertically secures the upper end of the back panel to the frame. Vertical tensioning of the back panel tautly secures the upper attachment member to the frame upper members.

As with the lower members, the upper members incline away from each other as they extend downwardly or toward the back panel. The upper attachment member includes a sleeve extending around the upper frame members. Vertical tensioning of the back panel tightens the sleeve onto the upper members as the sleeve is forced toward portions of the upper members disposed farther apart.

Thus, by using sleeves on tapered frame portions the harness that is quite easily kept taut without any bunching of the panels for a comfortable fit on the user's back. Furthermore, the system allows the back panel to adjust to fit the user; the shoulder straps also adjust in this manner. The sleeves secured on the inclined frame portions remain taut without extra buckles, straps or laces to secure and constantly readjust. These sleeves are also less costly to manufacture and assemble on the frame than prior frame harness systems.

BRIEF DESCRIPTION OF THE DRAWINGS

The foregoing aspects and many of the attendant advantages of this invention will become better understood in view of the drawings wherein.

DETAILED DESCRIPTION OF THE PREFERRED EMBODIMENT

Figure 1:
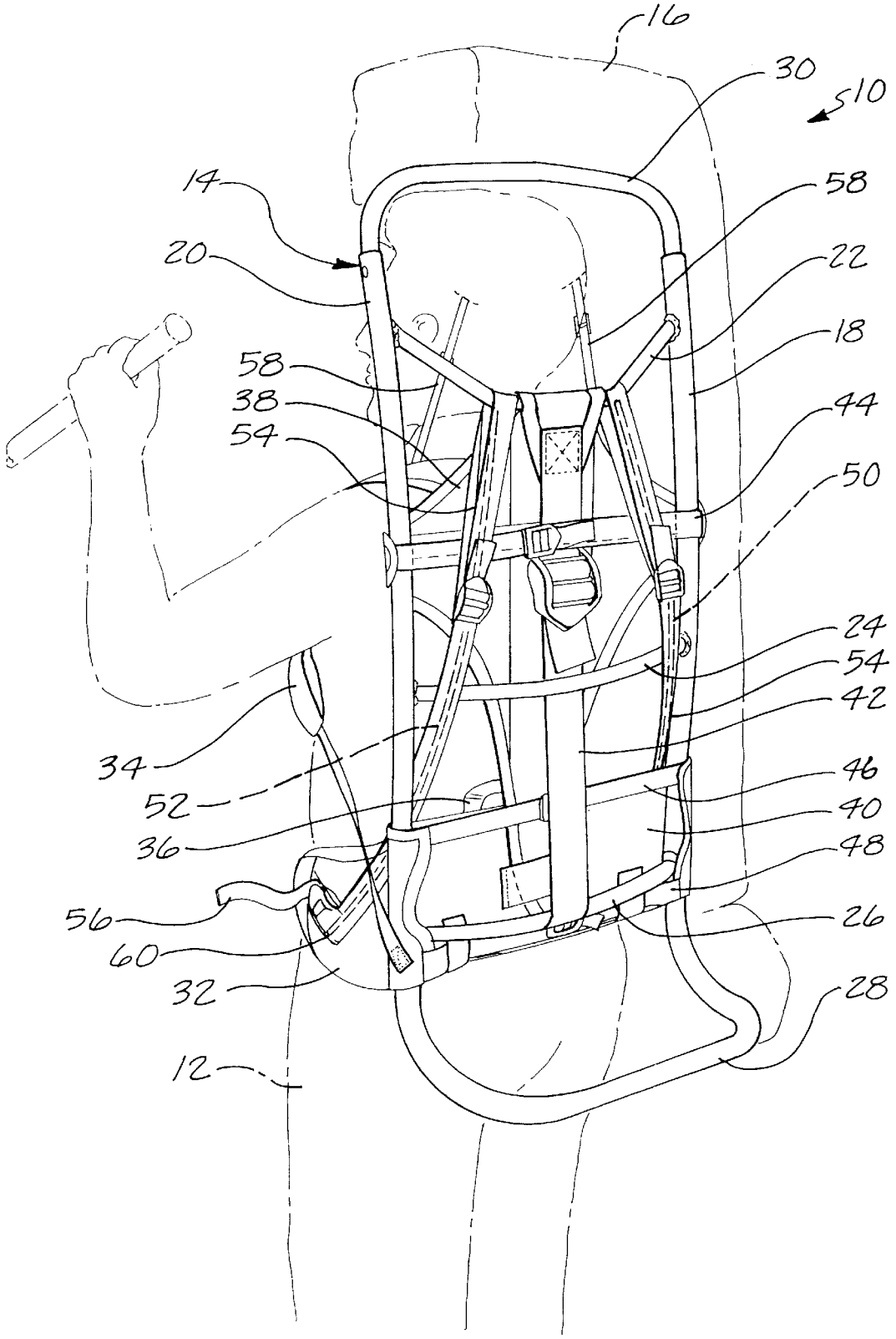
FIG. 1 provides a perspective view of the external pack frame and harness system of the present invention shown on the back of a hiker with the pack bag shown in phantom.

Referring now to the FIGURES, the preferred embodiment of the external frame pack of the present invention will now be described. A backpack 10 of the type generally used on the back of a hiker 12 is provided. The pack includes a frame 14 and a bag 16 (shown in phantom). Frame 14 may be of somewhat conventional or non-conventional construction. Frame 14 may be constructed of aluminum, other metals, composite materials, or other suitable materials. Bag 16 can be any conventional or non-conventional load-carrying structure that is held on and by frame 14.

In the preferred embodiment of the invention, frame 14 includes a right siderail 18 and a left siderail 20 that are generally parallel and vertically oriented when pack 10 is on the back of hiker 12. Preferably, siderails 18 and 20 extend from just below the back of hiker 12 to near the top of the head of hiker 12. Frame 14 also includes upper, middle, and lower crossbars 22, 24 and 26. These crossbars extend between right and left siderails 18 and 20 to form somewhat of a ladder configuration with the siderails. Upper crossbar 22 extends just below the upper ends of siderails 18 and 20, from one side to the other. From either end of upper crossbar 22, upper crossbar 22 angles somewhat downwardly at approximately 45–60° to a midsection that is generally horizontal when the pack is in the upright position on the back of hiker 12. Approximately the middle third of upper crossbar 22 is horizontal with the first and last thirds angled downwardly and somewhat rearwardly, away from the head of hiker 12. As with middle crossbar 24 and lower crossbar 26, the ends of upper crossbar 22 are welded in a conventional manner to siderails 18 and 20. Alternatively, other conventional or non-conventional means of attachment may be employed.

Middle crossbar 24 extends just below the midpoints of siderails 18 and 20 in a generally horizontal fashion. Middle crossbar 24 has a slightly arcuate shape, such that it bows rearwardly from its ends to its midsection away from hiker 12. Likewise, lower crossbar 26 bows rearwardly, but is substantially horizontal in the preferred embodiment. Lower crossbar 26 extends from near the lower ends of siderails 18 and 20. Frame 14 also includes a shelf 28 extending downwardly and rearwardly from siderails 18 and 20. Preferably, shelf 28 is an integrally bent portion of right and left siderails 18 and 20. Thus, siderails 18 and 20 are formed from the same piece of tubular aluminum forming a U-shape. The bottoms of right and left siderails 18 and 20 bend rearwardly and inwardly and then directly toward each other to the center of shelf 28. Shelf 28 may provide additional support to bag 16 or other items to be carried beneath bag 16 such as a tent or sleeping bag. In the preferred embodiment of the invention, shelf 28 and most of frame 14, is of a conventional construction, but may alternatively be modified to any conventional or non-conventional form.

Frame 14 further includes an extension tube 30 projecting upwardly from the top ends of siderails 18 and 20 in an inverted U-shape configuration. As with many conventional external frame packs, extension tube 30 may be extended or retracted relative to siderails 18 and 20, the lower ends of extension tube 30 telescoped within the upper ends of siderails 18 and 20.

The present invention is intended to provide a comfortable flexible harness for any external frame. Such external frames are particularly efficient at carrying large loads comfortably on the back of hiker 12. Such a rigid frame as the one described above will hold a large load on the back of the hiker while keeping the load slightly removed from direct contact with the hiker and providing a rigid support for the load.

The interface between the frame, which carries the load, and hiker 12 is the harness system. The present invention provides a unique harness system that is more durable, more comfortable, and transfers the load out to the sides of the hips in a more efficient manner, while still allowing flexibility of movement of the hiker without upsetting the balance of the frame and the load.

The harness system of the present invention includes a hip belt 32 including a lumbar pad 36, shoulder straps 34, a back panel 38, and a lower panel 40. Hip belt 32 is constructed generally according to conventional high-end hip belts on the market with the exception of a load strap 56 and an attachment structure for flexible stays as will be described below. Hip belt 32 is secured to lower panel 40 and thus to frame 14. It should be noted that the majority of the load of pack 10 is carried by hiker 12 at the hips such that hip belt 32 transfers the load to hiker 12. Shoulder straps 34 help stabilize the load and hold frame 14 near the back of hiker 12, but are not intended as primary load-carrying members, as the comfort of hiker 12 is much greater with the load carried primarily on the hips. A lumbar pad 36 is positioned in the middle of hip belt 32 to nest in the small of the back of hiker 12.

Shoulder straps 34 extend from back panel 38 over the shoulder of hiker 12 and down to a lower portion of siderails 18 and 20 of frame 14. Shoulder straps 34 may be somewhat conventional in construction. However, the upper attachment structure of shoulder straps 34 is non-conventionally attached to back panel 38 as will be described in more detail below. A sternum strap (not shown) may also be secured between the forward sides of shoulder straps 34 in a more conventional manner.

Back panel 38 resists the forwardly directed forces placed on frame 14 by shoulder strap 34 to keep frame 14 from direct contact with the back of hiker 12. Thus, back panel 38, also keeps the load within bag 16 removed from direct contact with the back of hiker 12. Unlike conventional back panels, back panel 38 has somewhat of a cross-shape or diamond configuration. The upper end of back panel 38 extends around the midsection of upper crossbar 22. The lower end of back panel 38 extends beneath lower crossbar 26. The right and left corners of back panel 38 extend around right and left siderails 18 and 20, respectively. Vertical tension strap 42, which extends between the ends on the opposite side of upper crossbar 22 and lower crossbar 26, tensions and pulls taut the upper end and lower ends of back panel 38. The function and advantages of vertical tension strap 42 will be discussed in more detail below in connection with FIGS. 4–6. A horizontal tension strap 44 is also employed to pull the right and left corners of back panel 38 into a taut position.

Lower panel 40 also includes horizontal straps 46 and 48 to hold lower panel 40 taut to resist the forces pushing frame 14 against the lower back of hiker 12. Upper strap 46 extends between the upper comers of the rectangular-shaped lower panel 40 while lower strap 48 extends between the lower corners. Each of straps 46 and 48 include a buckle or other tensioning member to increase the tension on lower panel 40. Unlike back panel 38, lower panel 40 does not include a vertical tension strap. As explained below, other means are employed to ensure the vertical extension of lower panel 40.

Another unique feature of the present invention includes right and left flex stays 50 and 52 that transfer the load of pack 10 to the sides of the hips of hiker 12 rather than having the entire load rest in the center of the lower back or lumbar region of hiker 12. Flex stays 50 and 52 are preferably constructed of fiberglass composite rods that extend from upper crossbar 22 behind middle crossbar 24 in front of lower panel 40 to a connection at the sides of hip belt 32. As explained below in more detail in connection with FIGS. 2 and 3, load straps 56 are connected to the lower ends of stays 50 and 52. Stays 50 and 52 are also held within stay webbing 54. Webbing 54 provides enclosed socks to hold the lower two-thirds of each of flex stays 50 and 52, while the upper third portion of webbing 54 is not sewn at its edges into a sock configuration to allow for tensioning of webbing 54 by looping it over the top of upper crossbar 22 and by utilizing adjustment sliders or buckles.

Also illustrated in FIG. 1 are lift straps 58 extending from the top forward side of shoulder straps 34 to an attachment with bag 16. Alternatively, lift straps 58 may attach directly to frame 14. Lift straps 58 work in a conventional manner to take the load from shoulder straps 34 and transfer it onto the frame to be carried by hip belt 32 on the hips of hiker 12. In the present invention, lift straps 58 also pull frame 14 closer to the back of the user and help pre-load flex stays 50 and 52.

Figure 2:
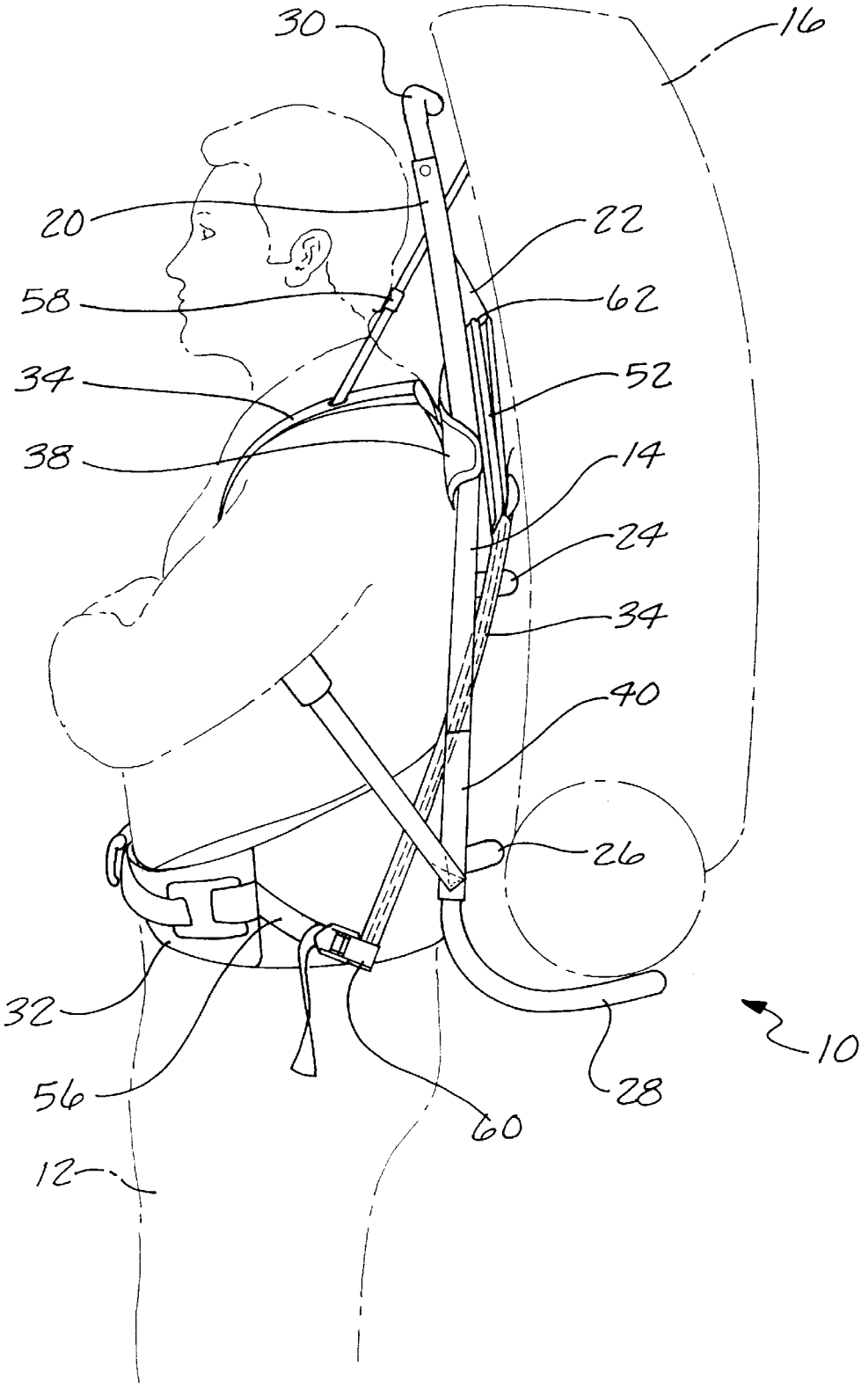
FIG. 2 is a side elevational view of the external frame and harness system on the back of a hiker.

Referring now to FIG. 2, note that the lower ends of flex stays 50 and 52 are received within lower receivers 60, which form a pocket at the rearward ends of load straps 56 attached to hip belt 32. Webbing 54 is sewn, or otherwise attached, directly to lower receiver 60. The upper ends of flex stays 50 and 52 extend within upper receivers 62, upper receivers 62 are constructed preferably by providing holes in the bottom of upper crossbar 22 sized to receive flex stays 50 and 52 at approximately the bends in upper crossbar 22. Thus, the connection of the upper ends of flex stays 50 and 52 directly with external frame 14 allows the load to transfer through stays 50 and 52 to hip belt 32. Due to the flexible nature of flex stays 50 and 52, hiker 12 is able to move, such as when walking or otherwise climbing and hiking, with flex stays 50 and 52 bending and moving with hiker 12 while still supporting the load contained within bag 16 on frame 14. Thus, a rigid external frame is employed with a flexible harness that transfers the load to the sides of the hips of hiker 12 instead of carrying the load in the lumbar region of the back or on the shoulders. This is a much more comfortable configuration and location to carry the load and hiker 12 is thus able to hike with more comfort and less fatigue or uncomfortable hot spots.

The upper ends of flex stays 50 and 52 could alternatively be connected to bag 16, another portion of frame 14 or even could be interconnected with lift straps 58. The basic functioning of flex stays 50 and 52 is to transfer the load to the sides of the hips of the user while providing a flexible harness between the user and the load such that the entire load does not shift when hiker 12 moves his or her hips while carrying the load.

Figure 3:
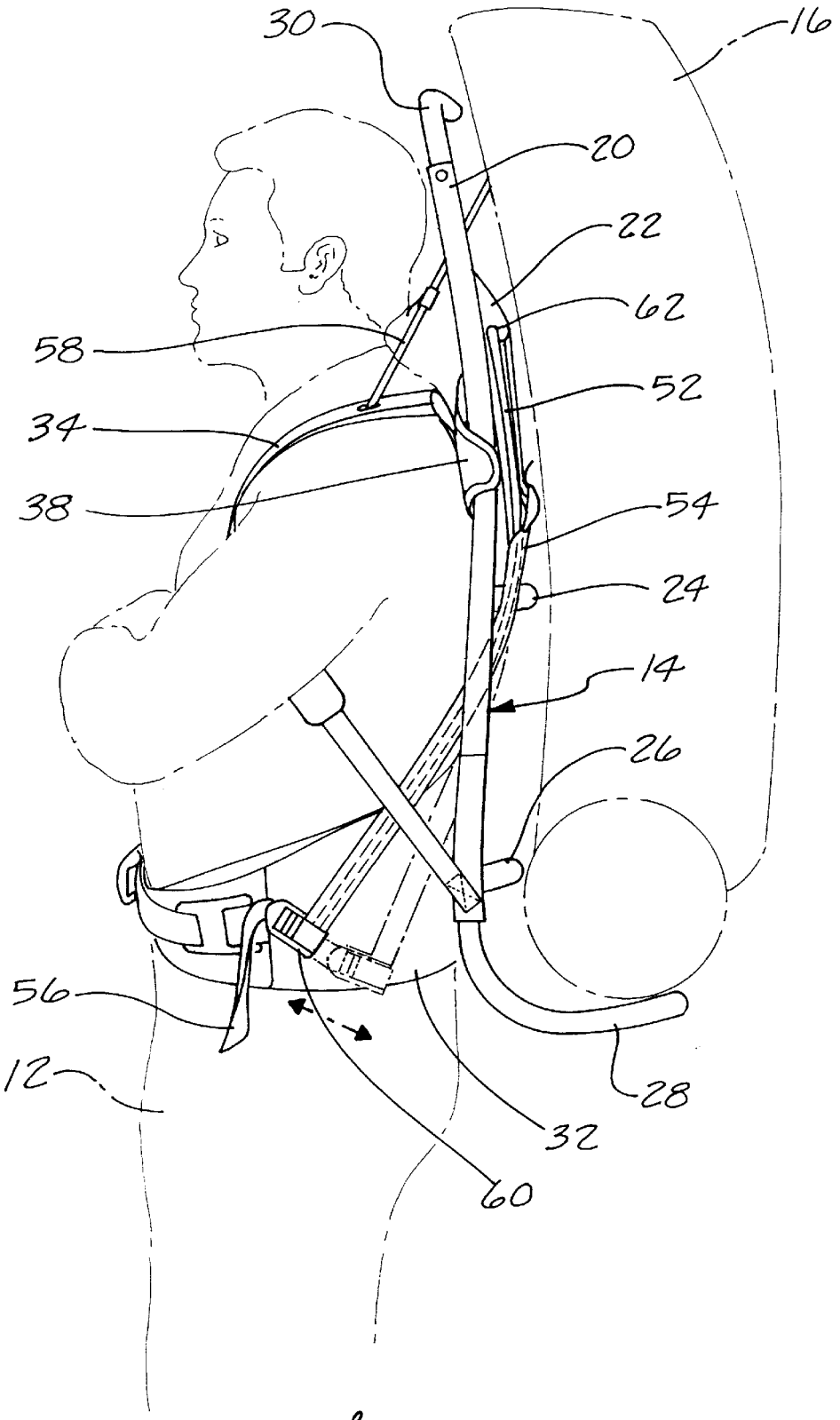
FIG. 3 is another side elevational view of the pack of the present invention with the flex stays in a further loaded configuration.

FIG. 3 illustrates the functioning of load straps 56, which further enhance the adjustable and load-carrying features of the harness system of the present invention. By pulling load strap 56 into a tighter position, flex stays 50 and 52 may be further bent into a higher pre-load condition. Such adjustment has the further effect of transferring the load forward on the hips of the user and holding the load in a more stable position while still allowing flexibility of the harness system. The lack of flexibility in prior art harness systems has contributed to the shift of the use of external frame packs to internal frame packs. However, as discussed above in the background, internal frame packs are not as efficient as load carriers and do not provide the same comfort benefits of a cooler interface between the load and hiker. However, the flex stays of the present invention allow the harness to move with the hiker, while the load is more isolated from such movement and can remain more stable and rigid. While hiking, the preload on flex stays 50 and 52 can easily be changed by hand so as to vary the positioning and feel of pack 10 on the back and hips of hiker 12. Similarly, lift straps 58 may adjust while hiking to change the preload of flex stays 50 and 52 and shift the weight of pack 10 for more comfortable transition. With this harness system, the load may be pulled closer to the back and ride more stable with movement of the hiker since the harness is flexible and forgiving, while the frame remains rigid and able to efficiently and effectively carry a large load.

Figure 4:
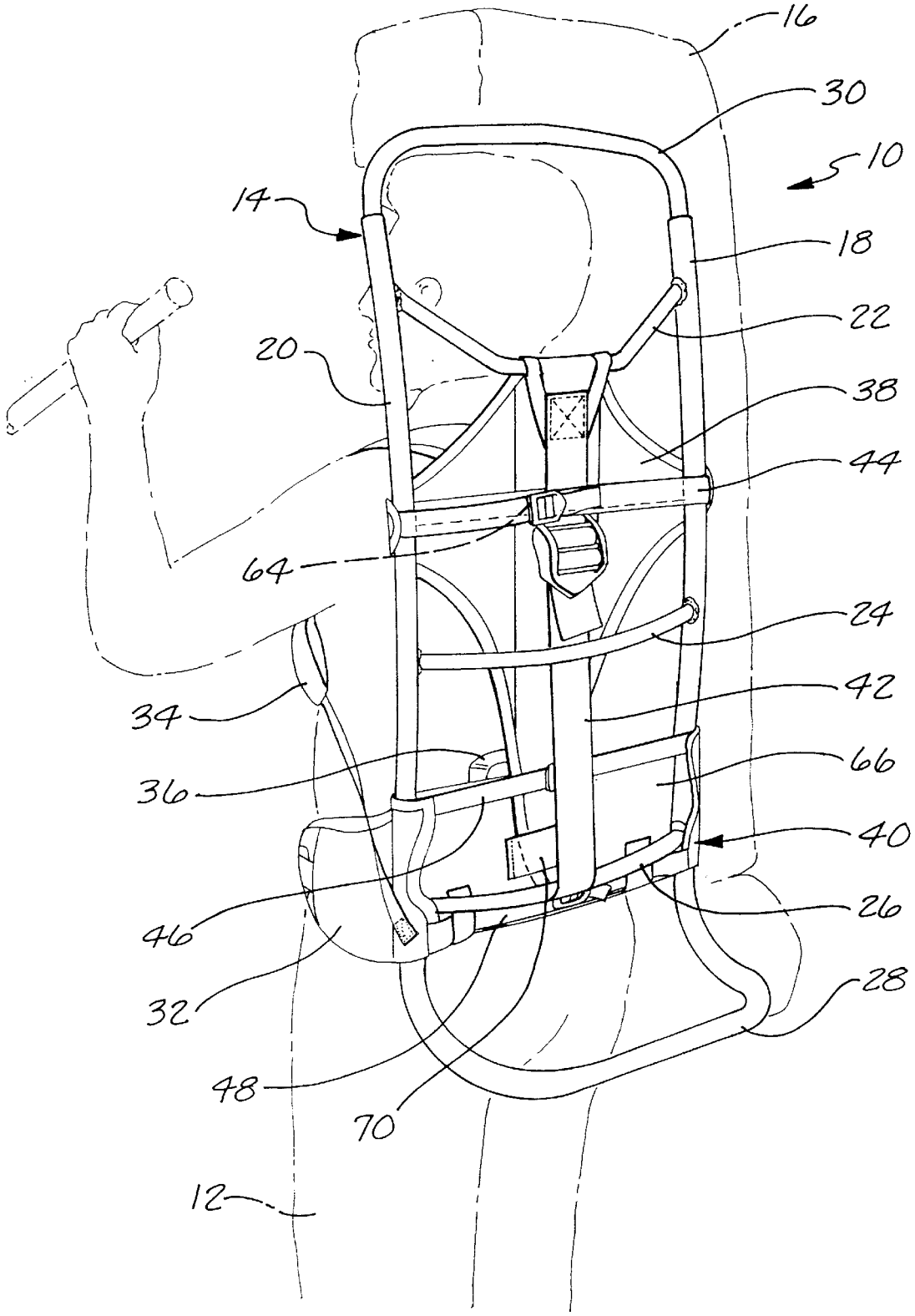
FIG. 4 provides a perspective view of the frame and harness system focusing on the back and lower panels with the flex stays removed.
Figure 5:
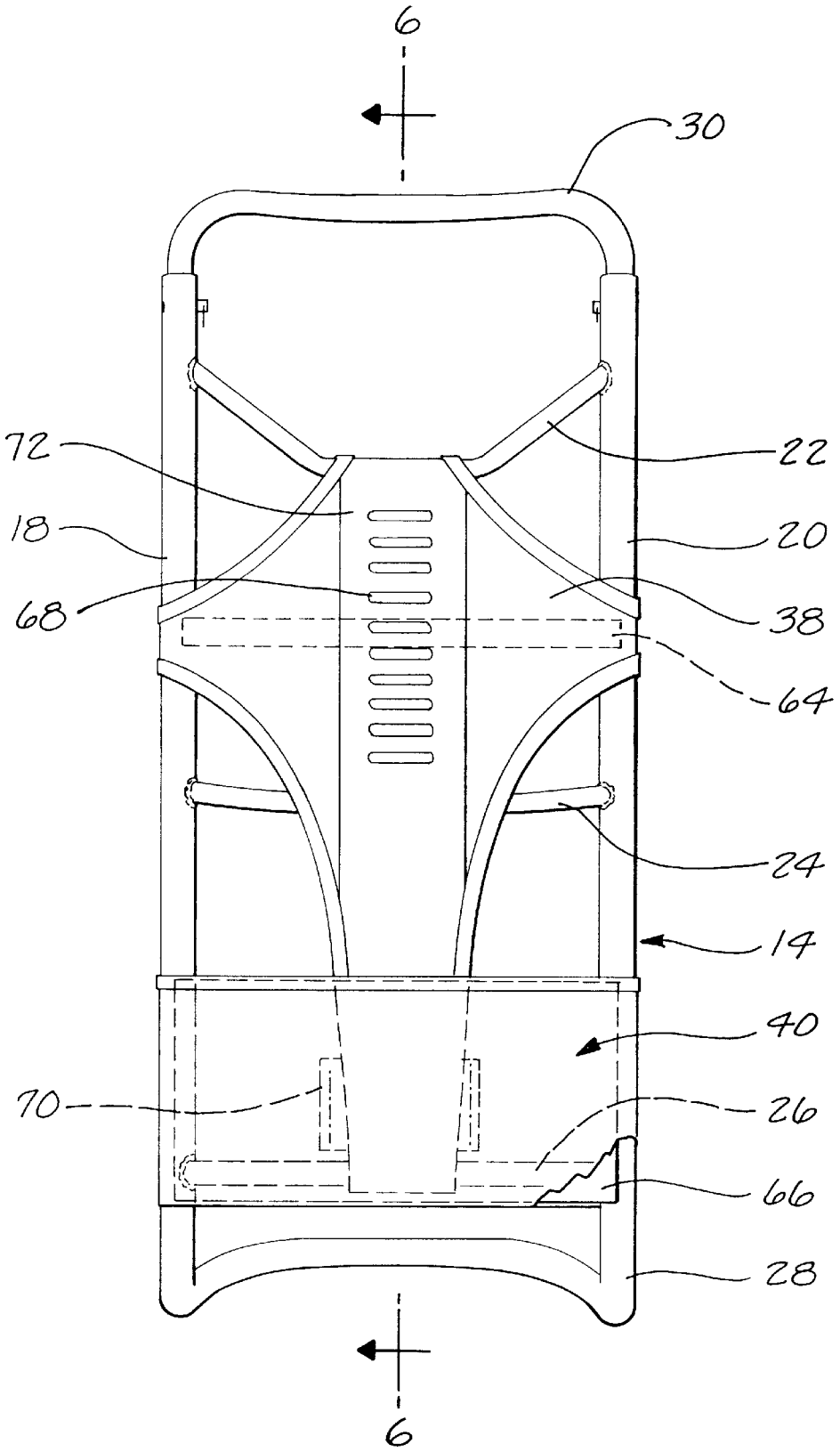
FIG. 5 is a front elevational view of the pack frame and harness system illustrated in FIG. 4 without the shoulder straps and hip belt.
Figure 6:
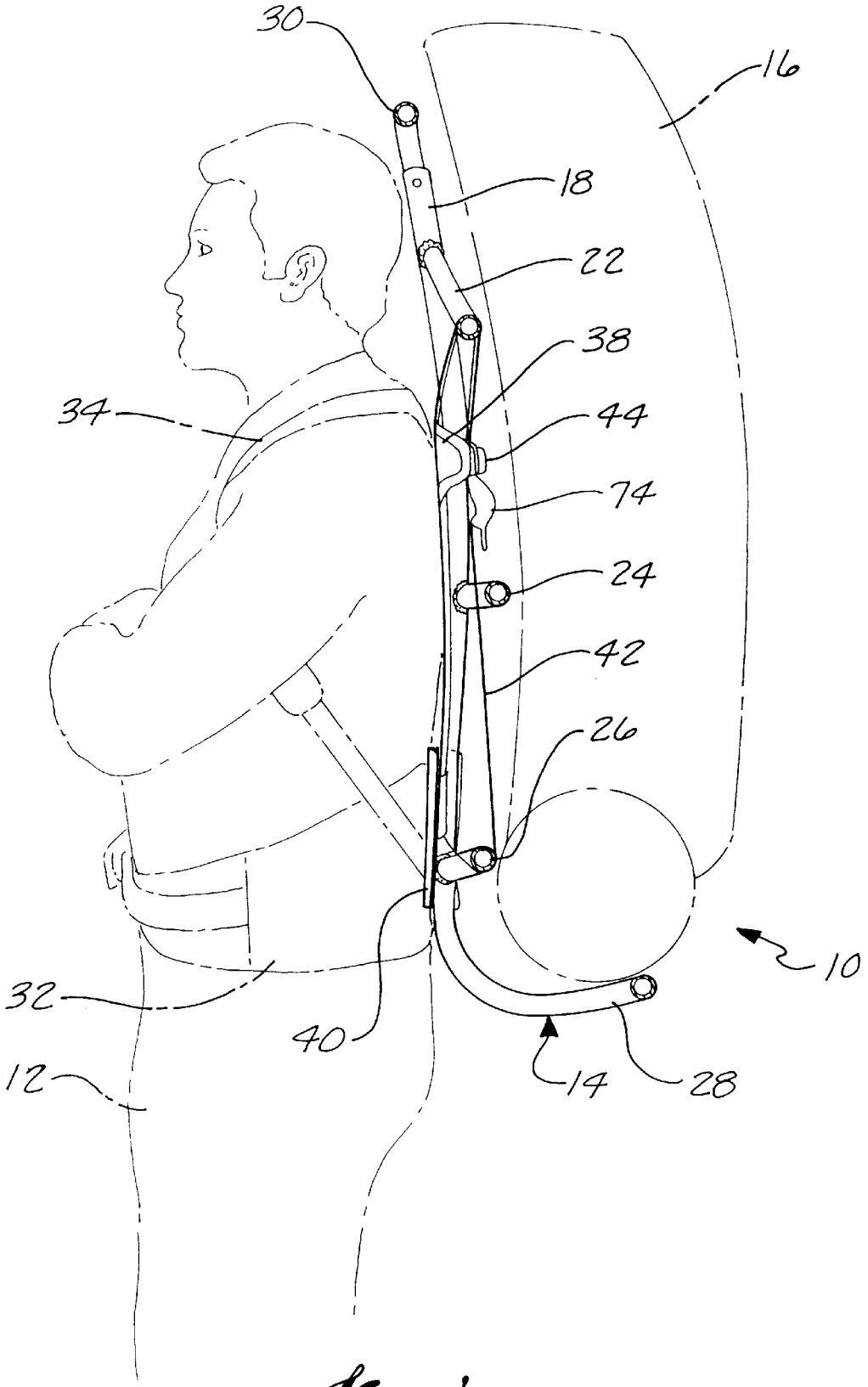
FIG. 6 is a side elevational view of a cross-cut through the center of the frame with the hiker, the hip belt, the shoulder strap and the bag shown in phantom.

Referring now to FIGS. 4–6, further details of back panel 38 and lower panel 40 will now be discussed. Note in these FIGURES that flex stays 50 and 52, as well as lift straps 58, have been removed for clarity of presentation of back panel 38 and lower panel 40. As discussed above, back panel 38 has a generally diamond or cross-shape configuration. The angled sides of back panel 38 are somewhat inwardly curved to eliminate areas of slack when horizontal tensioning strap 44 and vertical tensioning strap 42 are properly tightened. The entire panel is thus held in a taut configuration without any sliding in one direction or the other to cause any wrinkles in back panel 38. Thus, back panel 38 is much more comfortable on the back of hiker 12 and more evenly distributes the load placed thereon while maintaining the proper spacing for coolness between pack 10 and hiker 12.

As discussed briefly above, the right and left corners of back panel 38 extend at least partially around the sides of right and left siderails 18 and 20. Horizontal tensioning strap 44 pulls the corners toward each other with the use of a slider buckle or other fastening device. Since the upper and lower corners of back panel 38 extend above upper crossbar 22 and below lower crossbar 26, respectively, back panel 38 has a longitudinal axis that is generally vertical. The upper and lower corners of back panel 38 extend over the crossbars and are tensioned together with vertical tensioning strap 42. Vertical tensioning strap 42 likewise includes a slider buckle assembly for tightening the connection and increasing the tension in a vertical direction on back panel 38. The lower end of back panel 38 extends through sleeve 70 sewn into the back of lower panel 40 to maintain the centered orientation of the lower end of back panel 38. Back panel 38 is preferably constructed with multiple layers of fabric and other material to provide a cool interface between the back of the user and frame 14, to properly transmit the forces involved, and to connect shoulder straps 34, as discussed in connection with FIG. 5. A horizontal flex bar 64 is also positioned within back panel 38. Horizontal flex bar 64 extends within back panel 38 in a horizontal configuration from siderail 18 to siderail 20. Horizontal flex bar 64 is a flat bar of preferably fiberglass material. Horizontal flex bar 64 helps to transmit the load to frame 14, while being flexible and comfortable within back panel 38.

Referring to FIGS. 4 and 5, lower panel 40 is constructed with a fabric material that is stretched around the lower ends of siderails 18 and 20 adjacent the connection of siderails 18 and 20 with lower crossbar 26. Lower strap 48 extends beneath lower crossbar 26 while upper strap 46 extends above lower crossbar 26. Tensioning of upper strap 46 and lower strap 48 increases the tension of lower panel 40. As seen in more detail in FIG. 5, lower panel 40 also includes a plastic panel sheet 66 secured to the back of the fabric layer of lower panel 40. Panel sheet 66 extends from siderail to siderail and from top to bottom of panel 40 to provide some rigidity to lower panel 40. Thus, the positioning and height of lower panel 40 does not change in a vertical direction as it is tensioned. Panel sheet 66 keeps the upper and lower extremities in their proper location so that no bunching of the fabric creates ripples, and the load is dispersed across the widest possible area. Panel sheet 66 is preferably constructed of a plastic material, but alternatively may be constructed of another somewhat flexible material that is stiff relative to the fabric used in lower panel 40 so as to maintain the basic shape of lower panel 40 for proper transmission of the loads involved.

FIG. 5 also illustrates slots 68 that are used to secure shoulder straps 34 to back panel 38. The midsection of back panel 38 includes an attachment strip 72 extending along the longitudinal axis thereof. Attachment strip 72 is preferably constructed of a Hypalon® material. Hypalon® is a composite rubber (or plastic) and fabric material. Horizontal slots 68 are provided in attachment strip 72 spaced vertically one from another to locate and attach shoulder straps 34. The ends of shoulder straps 34 are joined together and include hook and loop material to slip through one of slots 68 back out through a lower slot 68 and then fasten back onto itself. In this manner, shoulder straps 34 may be adjusted along the vertical longitudinal axis of back panel 38 for proper sizing to suit a particular individual. Preferably, the hook and loop fastener strip of shoulder straps 34 extends between an upper slot and a lower slot, five slots down from the upper slot selected.

FIG. 6 illustrates the vertical path of back panel 38 and vertical tensioning strap 42 for proper tensioning and load distribution of back panel 38 as discussed above. Note that a fastener 74 allows the tension in back panel 38 to be adjusted in a vertical direction. The vertical tensioning strap extends from the upper end of back panel 38 around the middle section of upper crossbar 22 behind middle crossbar 24 around lower crossbar 26 to its connection with the lower end of back panel 38. The larger and more evenly tensioned back panel 38 more comfortably and effectively transfers the load and stably holds the pack 10 on the back of hiker 12.

Figure 7:
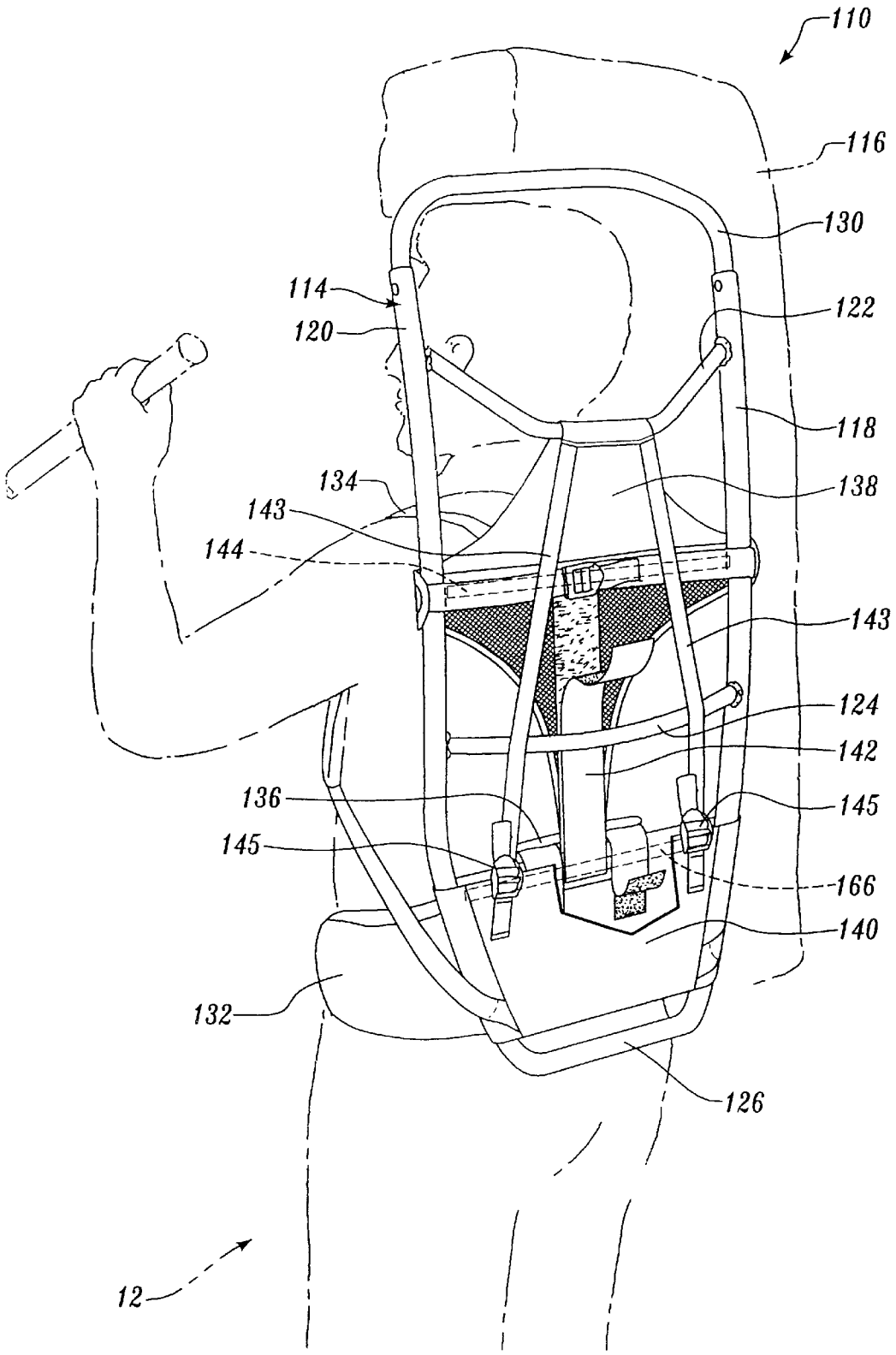
FIG. 7 is a rear perspective view of an alternate embodiment of the harness system with a tapered lower panel secured on a tapered frame.
Figure 8:
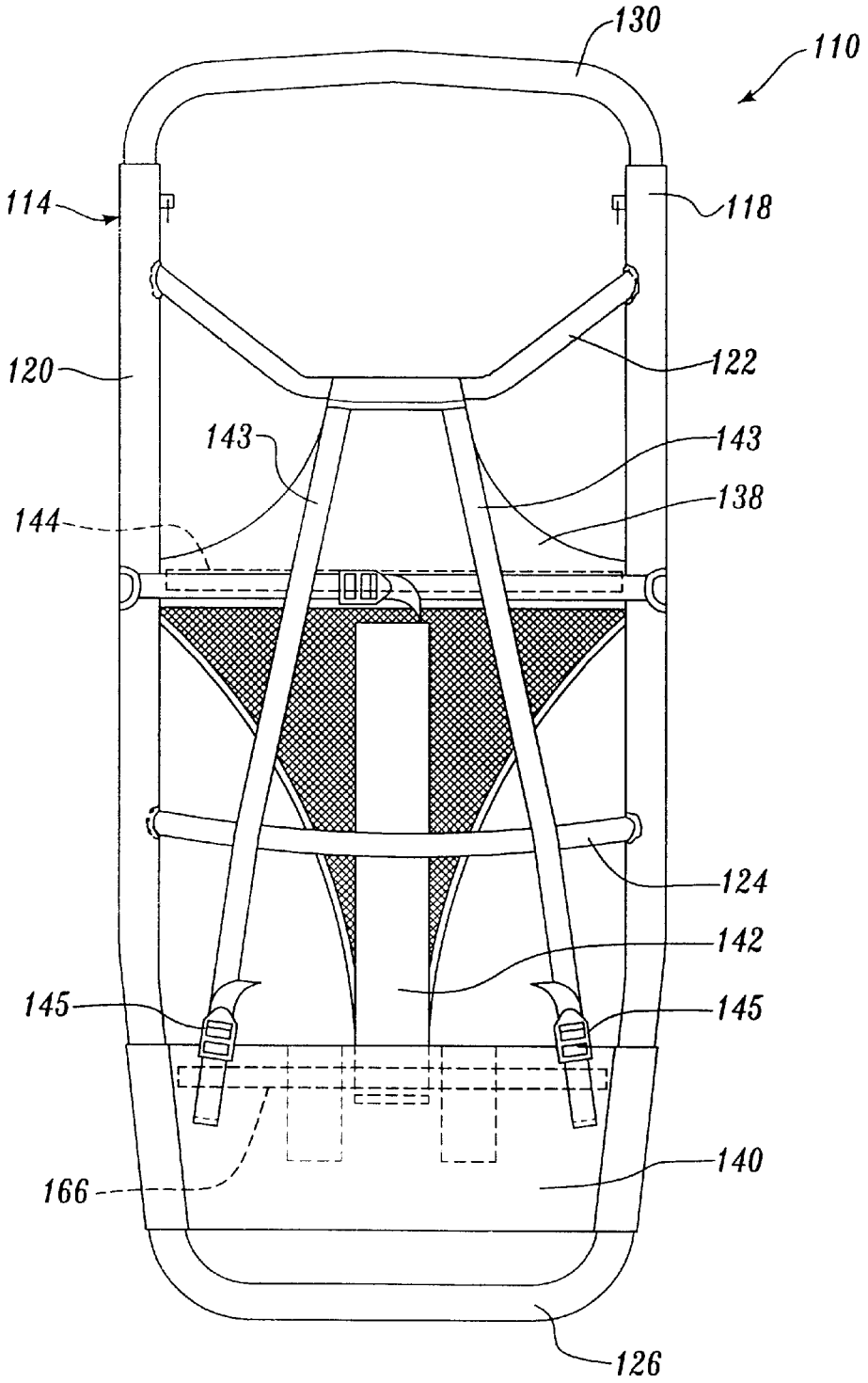
FIG. 8 is a rear elevational view of the frame of FIG. 7.

Alternate preferred embodiments of the harness system of the present invention will now be described with reference to FIGS. 7–9. Throughout the description of the further embodiments, the last two digits of numbered elements will correspond to related elements of the previous embodiments. Referring first to FIG. 7, pack 110 includes a frame 114 with right and left siderails 118 and 120 similar to those discussed above. However, the lower portions of right and left siderails 118 and 120 taper inwardly as they extend downwardly. They terminate with lower crossbar 126 connecting the two integrally. The tapered portion of siderails 118 and 120 at the lower end allows a sleeve 140 to be secured thereover. Sleeve 140 is constructed of a durable strong fabric material and is also tapered to somewhat match the taper between lower ends of siderails 118 and 120. Lower sleeve 140 is used for tensioning back panel 138. Sleeve 140 includes a flex bar 166 secured within an upper margin thereof preferably within the front side of sleeve 140. Flex bar 166 is preferably constructed of a fiberglass bar such that it is lightweight and strong. However, other materials could alternately be used or flex bar 166 could be omitted altogether with alternate securement of back panel 138, to sleeve 140.

Back panel 138 includes a lower end strap 142 at the bottom thereof. Lower end strap 142 extends around flex bar 166 about a mid-section thereof that is not completely enclosed within sleeve 140. Lower end strap 142 then doubles back onto the back of back panel 138. Preferably, a hook and fastener material such as VELCRO® is used such that lower end strap 142 secures to the back of back panel 138 in an adjustable manner to keep the tension on back panel 138 and to allow adjustment of the position of back panel 138 and shoulder straps 134 connected thereto. The upper end of back panel 138 includes upper end straps 143 secured thereto. Upper end straps 143 extend from upper crossbar 122 over which the upper end of back panel 138 is engaged. Upper end straps 143 then extend downwardly and are secured at their lower ends to the back panel of sleeve 140. Thus, with lower end strap 142 secured to the front panel of sleeve 140 and upper end strap 143 secured to the back panel of sleeve 140, a balanced tensioning is achieved for vertical tensioning of back panel 138 pulling between upper crossbar 122 and sleeve 140. Sleeve 140, due to its tapered nature onto tapered lower ends of siderail 118 and 120 is kept taut with the vertical force applied from straps 143 and 142. The straps tend to pull sleeve 140 more tightly up on the diverging rails 118 and 120. Adjustment buckles 145 secure to upper end straps 143 to adjust the positioning and tension of back panel 138. Adjustment buckles 145 also aid in vertical repositioning of back panel 138 as desired by hiker 12. For example, by loosening adjustment buckles 145 and tightening lower end strap 142, back panel 138 may be lowered relative to frame 114. Conversely, by loosening lower end strap 142 and tightening upper straps 143 with adjustment buckles 145, the vertical positioning of back panel 138 raises relative to frame 114.

Sleeve 140 also holds hip belt 132 and lumbar pad 136 as described above relative to lower panel 140. Thus, the upper force exerted on sleeve 140 by hip belt 132 further tensions and holds sleeve 140 onto tapered lower ends of siderails 118 and 120.

Shoulder straps 134 also secure to the sides of sleeve 140. Thus, shoulder straps 134 also aid in tensioning sleeve 140 onto frame 114. Shoulder straps 134 are preferably secured to the back portion of sleeve 140, but may alternatively secure to the front portion thereof or to hip belt 132.

Figure 9:
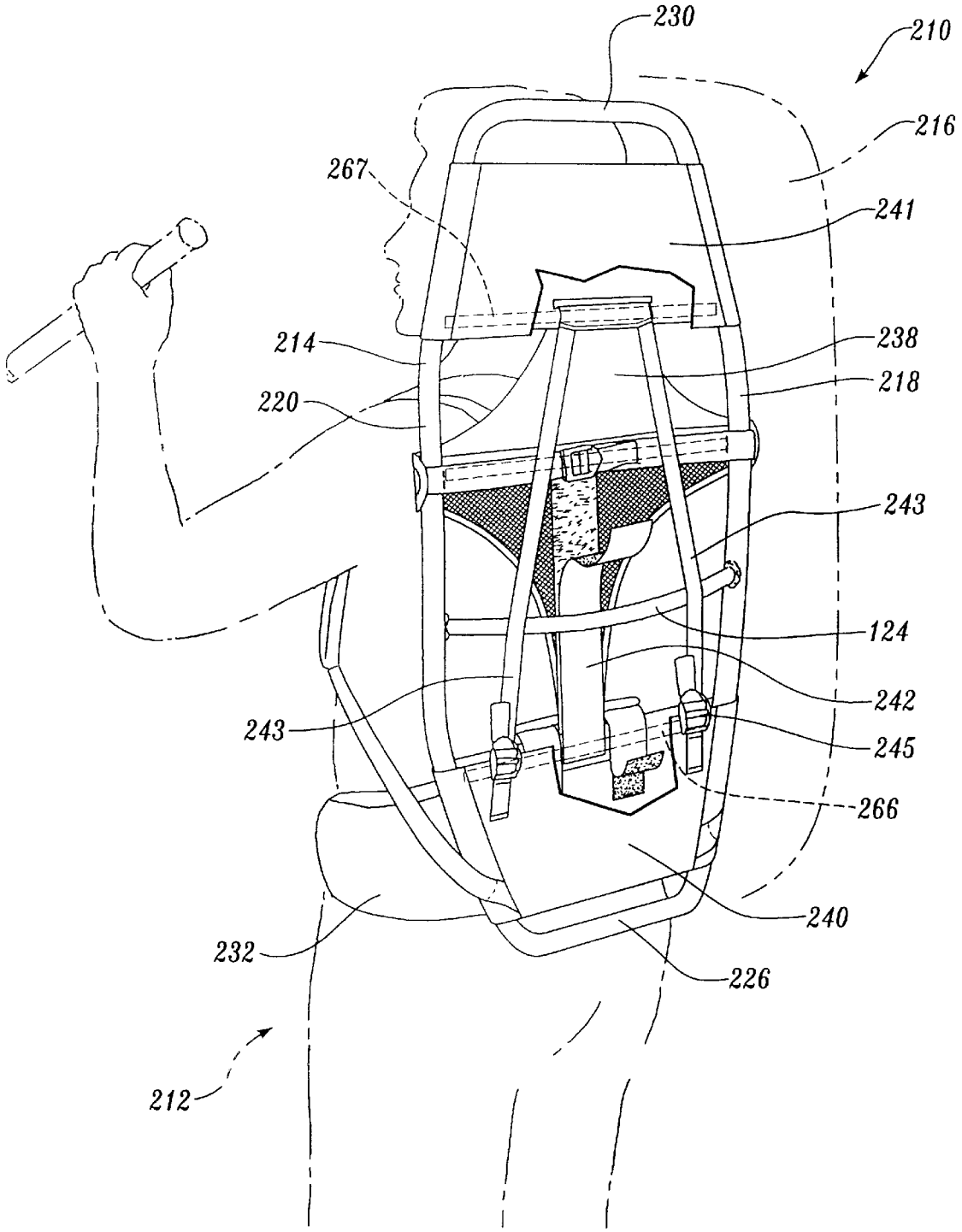
FIG. 9 is a perspective view of a further embodiment having tapered upper and lower sleeves on tapered frame sections.

FIG. 9 illustrates another alternate embodiment of the present invention wherein an upper sleeve 241 is provided that is somewhat similar to lower sleeve 240. In this embodiment right and left siderails 218 and 220 taper inwardly as they extend upwardly so as to secure upper sleeve 241. Upper sleeve 241 tapers to fit the upper portion of frame 214. Upper sleeve 241 includes an upper flex bar 267 secured within a lower portion thereof and extending from right siderail 218 to left siderail 220. Upper flex bar 267, like lower flex bar 266, provides some rigidity for securing the top end of back panel 238 thereover. Thus, when upper end straps 243 and lower end strap 242 are tightened, the entire lower portion of upper sleeve 241 is uniformly pulled downwardly to securely hold upper sleeve 241 on the upper, tapered portions of siderails 218 and 220.

In alternate embodiments, the frame may only include upper sleeve 241 without lower sleeve 240. The lower portion may be of conventional or non-conventional construction such as that described above with reference to FIG. 1–6. Furthermore, lower sleeve 240 or upper sleeve 241 may be secured to alternate tapered frame sections that are not integrally formed by siderails 218 and 220. As long as sleeves 240 and 241 ride on tapered sections such that they are forced taut when vertical tensioning is applied, then the function of the present invention is carried out. Thus, while the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A backpack comprising:

(a) frame having side members, a first upper member, and at least two lower members, said lower members extending at least somewhat upwardly and having at least portions thereof inclined with respect to each other;

(b) a back panel secured between said side members and having upper and lower ends between said upper and lower frame members;

(c) a tensioning member vertically tensioning said back panel, said tensioning member being secured to the lower end of said back panel; and (d) a lower attachment member secured to the lower end of said back panel and attached between said lower frame members, said attachment member vertically securing the lower end of said back panel to said frame, vertical tensioning of said back panel tautly securing said lower attachment member to said lower frame members.

2. The backpack of claim 1 further comprising an upper tensioning member secured to the upper end of said back panel.

3. The backpack of claim 1, wherein said frame further comprises a second upper member, said upper members extending at least somewhat downwardly and having at least portions thereof inclined with respect to each other, said backpack further comprising an upper attachment member secured to the upper end of said back panel and attached between said first and second upper frame members, said upper attachment member securing the upper end of said back panel to said frame, vertical tensioning of said back panel tautly securing said upper attachment member to said frame upper members.

4. The backpack of claim 3, wherein said upper members slant away from each other as they extend downwardly.

5. The backpack of claim 4, wherein said upper attachment member includes a sleeve extending around said upper frame members, vertical tensioning of said back panel tightening said sleeve onto said upper members as the sleeve is forced toward portions of said upper members disposed farther apart.

6. The backpack of claim 1, wherein said lower members slant away from each other as they extend upwardly.

7. The backpack of claim 6, wherein said lower attachment member includes a sleeve extending around said lower frame members, vertical tensioning of said back panel tightening said sleeve onto said lower members as the sleeve is forced toward portions of said lower members disposed farther apart.

8. The backpack of claim 7, wherein said lower members are integrally formed with said side members of said frame, said side members tapering toward each other at least at their lower portions as they extend downwardly forming said lower members.

9. The backpack of claim 8, further comprising a hip belt attached to said sleeve.

10. The backpack of claim 8, further comprising a lumbar pad attached to said sleeve.

11. The backpack of claim 7, wherein said lower attachment member includes a crossbar attached to said sleeve near an upper margin thereof.

12. The backpack of claim 11, wherein the lower end of said back panel is attached to said crossbar.

13. The backpack of claim 11, wherein said crossbar comprises fiberglass.

14. The backpack of claim 7, wherein the upper end of said back panel includes at least one strap engaging said upper member and extending therefrom down to said sleeve and attached to said sleeve.

15. The backpack of claim 14, wherein said at least one strap includes a length adjuster and wherein said lower end of said back panel is adjustably connected to said sleeve such that the vertical position of said back panel may be shifted.

16. The backpack of claim 15, further comprising shoulder straps attached to said back panel.

17. A backpack comprising:

(a) frame having side members, at least two upper members, and at least one lower member, said upper members extending at least somewhat downwardly and having at least portions thereof inclined with respect to each other;

(b) a back panel secured horizontally between said side members and having upper and lower ends between said upper and lower frame members;

(c) horizontal and vertical tensioning mechanisms for horizontal and vertical tensioning of said back panel; and (d) an upper attachment member secured to the upper end of said back panel and attached between said upper frame members, said attachment member vertically securing the upper end of said back panel to said frame, vertical tensioning of said back panel tautly securing said upper attachment member to said frame upper members.

18. The backpack of claim 17, wherein said upper members slant away from each other as they extend downwardly.

19. The backpack of claim 18, wherein said upper attachment member includes a sleeve extending around said upper frame members, vertical tensioning of said back panel tightening said sleeve onto said upper members as the sleeve is forced toward portions of said upper members disposed farther apart.

20. The backpack of claim 19, wherein said upper members are integrally formed with said side members of said frame, said side members tapering toward each other at least in the region of attachment of said sleeve as they extend upwardly forming said upper members.

21. A backpack comprising:

(a) a frame having siderails, an upper frame member, and at least two lower frame members, said lower frame members extending upwardly and outwardly with respect to one another;

(b) a back panel secured between said siderails and having an upper end engaging said upper frame member and a lower end secured to said lower frame members;

(c) a lower attachment member engaged with said lower frame members, said lower attachment member securing said lower end of said back panel to said lower frame members; and (d) a tensioning member secured to at least one of said upper and lower ends of said back panel, tensioning of at least one of the ends of said back panel tautly securing said lower attachment member to said lower frame members.

22. The backpack of claim 21, wherein said lower attachment member comprises a sleeve engaged with said lower frame members.

23. The backpack of claim 22, wherein said lower frame members are formed by the lower ends of said siderails.

* * * * *